US006943642B1

(12) United States Patent
Takadate et al.

(10) Patent No.: US 6,943,642 B1
(45) Date of Patent: Sep. 13, 2005

(54) NONRECIPROCAL CIRCUIT ELEMENT AND METHOD OF MANUFACTURING THE SAME

(75) Inventors: Kinshiro Takadate, Niigata-ken (JP); Toshio Takahashi, Niigata-ken (JP); Eiichi Komai, Niigata-ken (JP); Hitoshi Onishi, Niigata-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/662,737

(22) Filed: Sep. 15, 2003

(30) Foreign Application Priority Data

Sep. 20, 2002 (JP) ..... 2002-275582

(51) Int. Cl.[7] ..... H01P 1/32

(52) U.S. Cl. ..... 333/24.2; 333/1.1

(58) Field of Search ..... 333/24.2, 1.1

(56) References Cited

U.S. PATENT DOCUMENTS 3,573,665 A * 4/1971 Knerr ..... 333/1.1
6,472,960 B1 * 10/2002 Ishikawa et al. ..... 333/204
6,646,608 B2 * 11/2003 Yoneda ..... 343/700 MS

FOREIGN PATENT DOCUMENTS

JP 6-338707 12/1994
JP 7-212107 8/1995
JP 8-8612 1/1996

* cited by examiner

*Primary Examiner*—Stephen E. Jones
(74) *Attorney, Agent, or Firm*—Brinks Hofer Gilson & Lione

(57) ABSTRACT

A nonreciprocal circuit element includes a magnetic plate having through holes; center conductors crossing each other at a predetermined angle on a side associated with a first surface of the magnetic plate; and a common electrode disposed on a side associated with a second surface of the magnetic plate and connected to the center conductors via the through holes.

31 Claims, 6 Drawing Sheets

NONRECIPROCAL CIRCUIT ELEMENT AND METHOD OF MANUFACTURING THE SAME

This application claims the benefit of priority to Japanese Patent Application 2002-275582, filed on Sep. 20, 2002.

BACKGROUND OF THE INVENTION

1. Field of the Invention

The present invention relates to nonreciprocal circuit elements and methods of manufacturing a nonreciprocal circuit element. Particularly, the present invention relates to a nonreciprocal circuit element that is small in size, that exhibits high performance, and that is suitable for mass production, and to a manufacturing method thereof.

2. Description of the Related Art

Lumped-constant isolators, which are a type of nonreciprocal circuit element, are high-frequency components that allow signals to be transmitted in a direction of transmission without a loss while inhibiting transmission of signals in the opposite direction, and are used in transmission circuits of mobile communication devices such as cellular phones. Recently, as the sizes of cellular phones become smaller, a demand exists for further miniaturization of isolators used in cellular phones.

As nonreciprocal circuit elements that are similar to isolators, circulators are known. Techniques for reducing the sizes of circulators and improving performance thereof are disclosed in FIG. 10 of Japanese Unexamined Patent Application Publication No. 6-338707. FIG. 10 of Japanese Unexamined Patent Application Publication No. 6-338707 discloses a circulator in which conductors are embedded in a YIG lamination and the conductors are connected to a magnetic rotor via through holes or the like in order to reduce size and improve performance.

The magnetic rotor mentioned above is manufactured by coating green sheets composed of YIG powder, binder, and flux with silver paste or the like by printing or the like, and sintering the green sheets. However, when silver paste or the like is used, sintering temperature must be kept low. This has lead to insufficient sintering and failure to obtain a YIG magnetic component having satisfactory characteristics. Thus, it has been difficult to improve performance of circulators.

Furthermore, the magnetic rotor manufactured has a polygonal shape. Thus, when the magnetic rotor is contained in a substantially rectangular-parallelepiped case, a useless space is formed between the magnetic rotor and the case, inhibiting miniaturization of circulators.

SUMMARY OF THE INVENTION

The present invention has been made in view of the situation described above, and an object thereof is to provide a nonreciprocal circuit element and an isolator that are small in size, that exhibit high performance, and that are suitable for mass production, and to a method of manufacturing a nonreciprocal circuit element.

In order to achieve the above object, the present invention employs the following schemes.

The present invention, in one aspect thereof, provides a nonreciprocal circuit element including a magnetic plate having a plurality of through holes; a plurality of center conductors crossing each other at a predetermined angle on a side associated with a first surface of the magnetic plate; and a common electrode disposed on a side associated with a second surface of the magnetic plate and connected to the center conductors via the through holes.

According to the nonreciprocal circuit element, since a magnetic plate having through holes formed in advance is used, a magnetic plate having favorable characteristics can be used, serving to improve characteristics of the nonreciprocal circuit element.

Preferably, in the nonreciprocal circuit element, the magnetic plate is contained in a case, and at least one of a vertical dimension and a horizontal dimension of the magnetic plate substantially coincides with a vertical dimension or a horizontal dimension of an interior of the case.

According to the nonreciprocal circuit element, since the sizes of the case and the magnetic plate substantially coincide with each other, a large planar area can be occupied by the magnetic plate even if the case is small. Accordingly, L (inductances) can be increased and C (capacitances) can be decreased by increasing the lengths of the center conductors, serving to suppress loss caused by the nonreciprocal circuit element.

Also preferably, in the nonreciprocal circuit element, capacitors connected to first ends of the center conductors are disposed on the side associated with the first surface of the magnetic plate.

According to the nonreciprocal circuit element, a space for disposing the capacitors need not be provided separately from a space for disposing the magnetic plate. Accordingly, the nonreciprocal circuit element can be implemented in a small size. Furthermore, loss can be reduced by increasing a planar area occupied by the magnetic plate and improving L of the center conductors.

Also preferably, in the nonreciprocal circuit element, the case is formed by a first yoke disposed on the side associated with the first surface of the magnetic plate, and a second yoke disposed on the side associated with the second surface of the magnetic plate so as to also function as a grounding electrode, the capacitors being connected to the second yoke via other through holes provided in the magnetic plate.

According to the nonreciprocal circuit element, since the capacitors are connected to the grounding electrode via the through holes provided in the magnetic plate, connecting wires need not be provided. Thus, the structure of the nonreciprocal circuit element can be simplified to improve mass productivity, and the nonreciprocal circuit element can be implemented in a small size.

Also preferably, in the nonreciprocal circuit element, terminal electrodes connected to the first ends of the center conductors are engaged with side edges of the magnetic plate.

According to the nonreciprocal circuit element, since the terminal electrodes are engaged with the side edges of the magnetic plate, a space for disposing the terminal electrodes can be reduced, so that the nonreciprocal circuit element can be implemented in a small size.

Also preferably, in the nonreciprocal circuit element, the center conductors are formed, by printing, over the magnetic plate via insulating layers.

According to the nonreciprocal circuit element, since the center conductors are formed by printing, as opposed to known nonreciprocal circuit elements, the center conductors need not be bent, and the center conductors can be precisely positioned over the magnetic plate.

Furthermore, since the center conductors can be formed thin, the nonreciprocal circuit element can be implemented in a small size.

Also preferably, in the nonreciprocal circuit element, an insulating spacer and a biasing permanent magnet are laminated on the side of the first surface of the magnetic plate, solder plating layers are formed on one surface, associated with the magnetic plate, of the insulating spacer, the solder plating layers electrically connecting the first ends of the center conductors to the capacitors and the terminal electrodes, respectively.

According to the nonreciprocal circuit element, since the center conductors are connected to the capacitors and the terminal electrodes via the solder plating layers, connecting wires need not be provided. Thus, the structure of the nonreciprocal circuit element can be simplified to improve mass productivity, and the nonreciprocal circuit element can be implemented in a small size. Furthermore, by forming the solder plating layers thin, the nonreciprocal circuit element can be implemented in an even smaller size.

Also preferably, in the nonreciprocal circuit element, the center conductors are formed on insulating films, and the insulating films are laminated over the magnetic plate with the center conductors facing the magnetic plate.

According to the nonreciprocal circuit element, since the insulating film having the center conductors are laminated, as opposed to known nonreciprocal circuit elements, the center conductors need not be bent, and the center conductors can be precisely positioned on the magnetic plate.

Furthermore, since the center conductors can be formed thin, the nonreciprocal circuit element can be implemented in a small size.

Also preferably, in the nonreciprocal circuit element, the capacitors are disposed on the insulating films.

According to the nonreciprocal circuit element, since the center conductors can be connected to the capacitors within the insulating films, connecting wires need not be newly provided. Thus, the structure of the nonreciprocal circuit element can be simplified to improve mass productivity, and the nonreciprocal circuit element can be implemented in a small size.

Furthermore, in the nonreciprocal circuit element, a terminating resistor may be connected to one of the center conductors of the nonreciprocal circuit element according to one of the arrangements described above.

According to the nonreciprocal circuit element, the nonreciprocal circuit element is small in size and is suitable for mass production.

Preferably, in the nonreciprocal circuit element, the terminating resistor is mounted on the second yoke, and the terminating resistor is electrically connected to the center conductors via another solder plating layer formed on one surface, associated with the magnetic plate, of the insulating spacer.

According to the nonreciprocal circuit element, since the terminating resistor is mounted on the second yoke, a connecting wire can be omitted. Furthermore, since the terminating resistor is connected to the center conductor via the solder plating layer, a connecting wire need not be provided. Thus, the structure of the nonreciprocal circuit element can be simplified to improve mass productivity, and the nonreciprocal circuit element can be implemented in a small size.

The present invention, in another aspect thereof, provides a method of manufacturing a nonreciprocal circuit element according to the present invention is such that a plurality of center conductors is laminated, via insulating layers, on a side associated with a first surface of a magnetic plate having through holes, and a common electrode is formed on a side associated with a second surface of the magnetic plate, capacitors are disposed in proximity to first ends of the center conductors, and terminal electrodes are engaged with side edges, adjacent to the first ends, of the magnetic plate, an insulating spacer having solder plating layers is laminated over the magnetic plate such that the solder plating layers are opposed at least to the first ends of the center conductors, and the solder plating layers are melted by heat to electrically connect the first ends to the capacitors and the terminal electrodes, respectively.

According to the method of manufacturing a nonreciprocal circuit element, an insulating spacer is laminated on center conductors, and solder plating layers are melted by heat to electrically connect the center conductors to terminal electrodes, respectively. Accordingly, a process of bending center conductors and a process of individually soldering capacitors and terminal electrodes, which have hitherto been required, are omitted, serving to improve productivity.

Furthermore, since the method simply incorporates constituent components sequentially and applies heat thereto, the constituent components can be precisely positioned and assembled.

The present invention, in yet another aspect thereof, provides a method of manufacturing a nonreciprocal circuit element according to the present invention is such that a plurality of insulating films having center conductors and capacitors is laminated on a side of a first surface of a magnetic plate having through holes, and a common electrode is formed on a side associated with a second surface of the magnetic plate, and terminal electrodes are engaged with side edges, adjacent to the first ends of the magnetic plate.

According to the method of manufacturing a nonreciprocal circuit element, the method simply mounts center conductors and capacitors simultaneously on a magnetic plate and incorporates a common electrode and terminal electrodes. Thus, a process of bending center conductors and encapsulating YIG ferrite and a process of individually soldering capacitors and terminal electrodes, which have hitherto been required, are omitted, serving to improve productivity. Furthermore, since the method simply incorporates constituent components sequentially, the constituent components can be precisely positioned and assembled.

Preferably, in the method of manufacturing a nonreciprocal circuit element according to the present invention, preferably, the center conductors are connected to the common electrode via the through holes.

DESCRIPTION OF THE PREFERRED EMBODIMENTS

FIRST EMBODIMENT

Now, a first embodiment of the present invention will be described with reference to the drawings.

Figure 1:
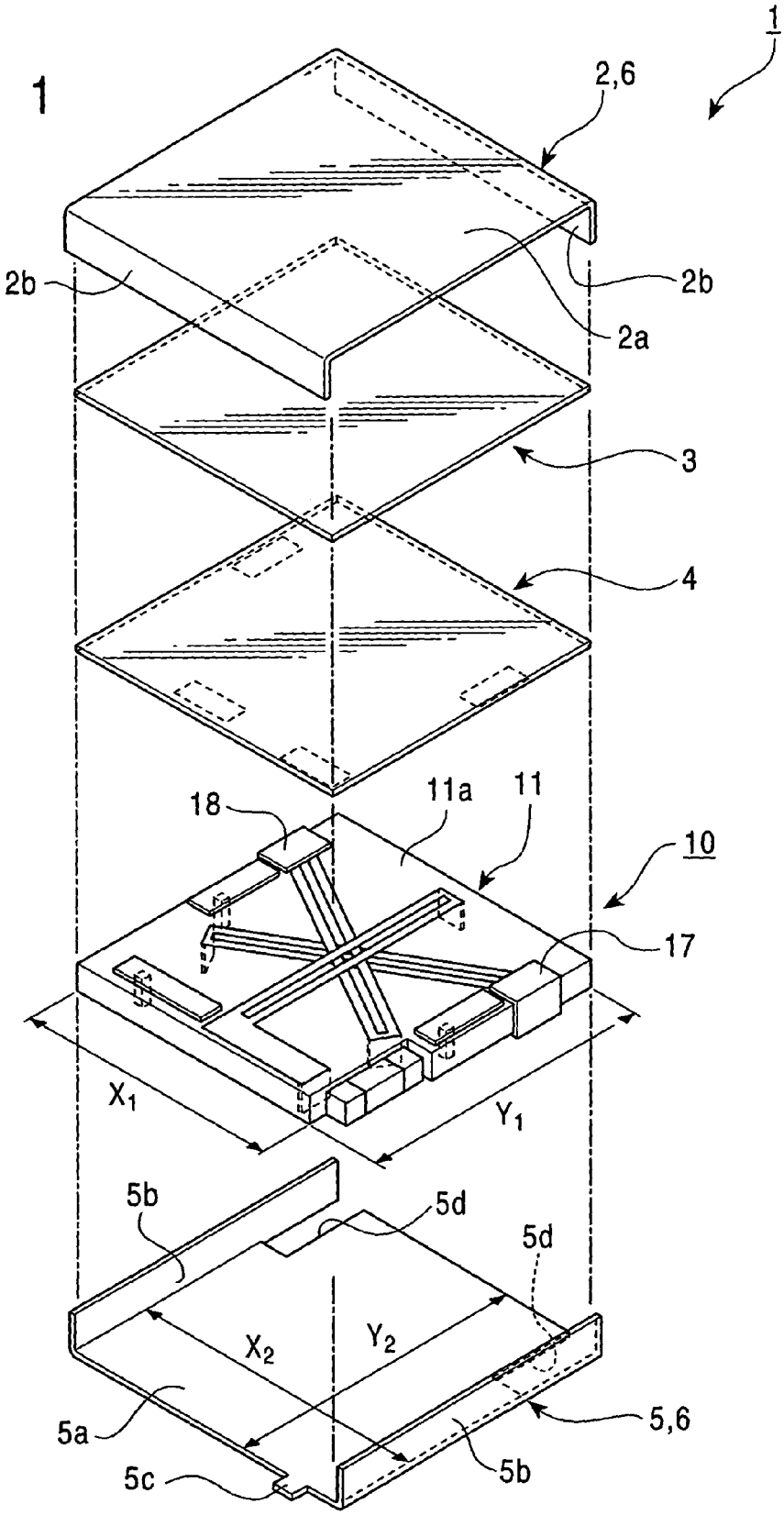
FIG. 1 is an exploded perspective view of an isolator according to a first embodiment of the present invention.
Figure 2:
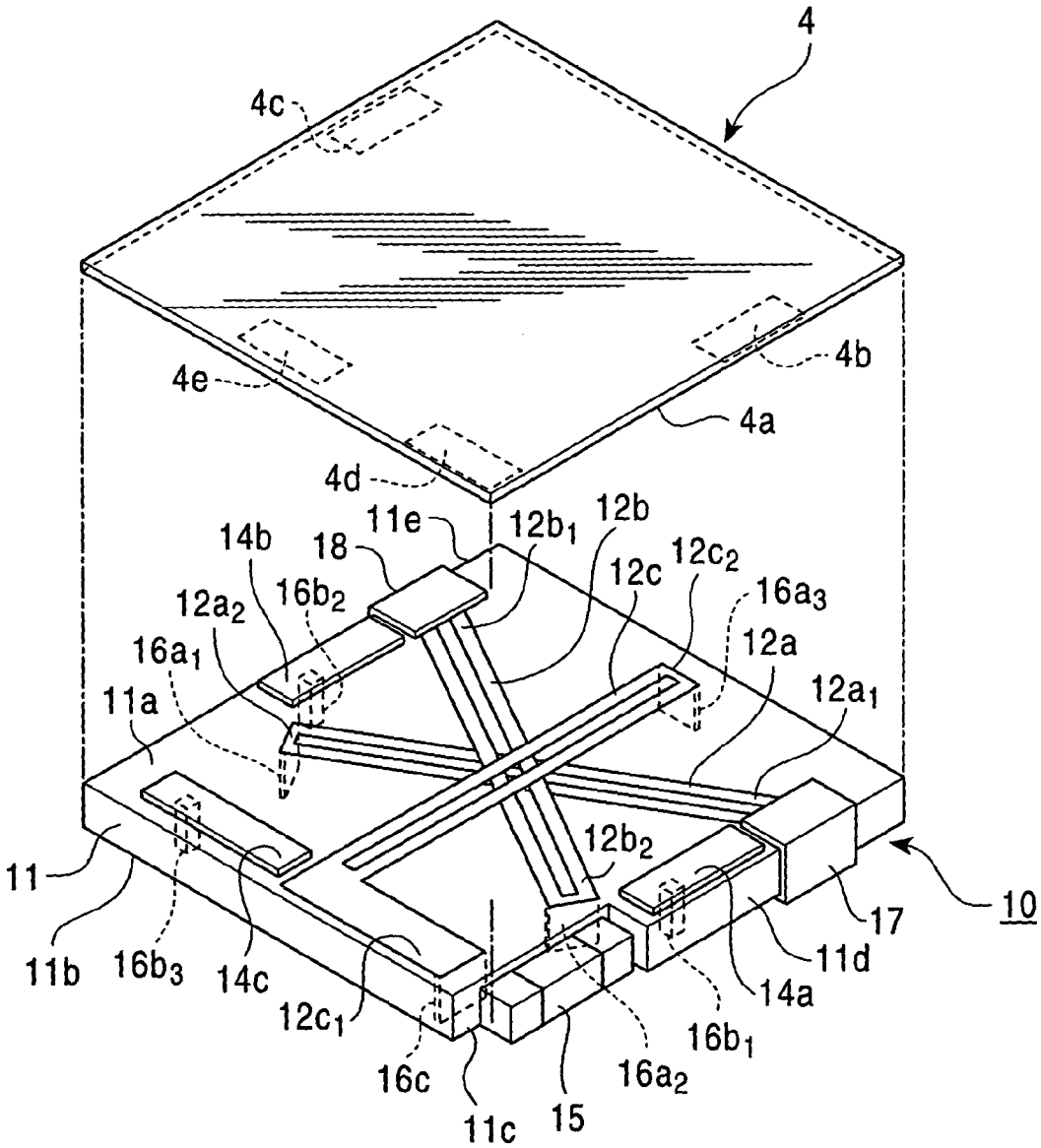
FIG. 2 is an exploded perspective view of main parts of the isolator according to the first embodiment of the present invention.
Figure 3:
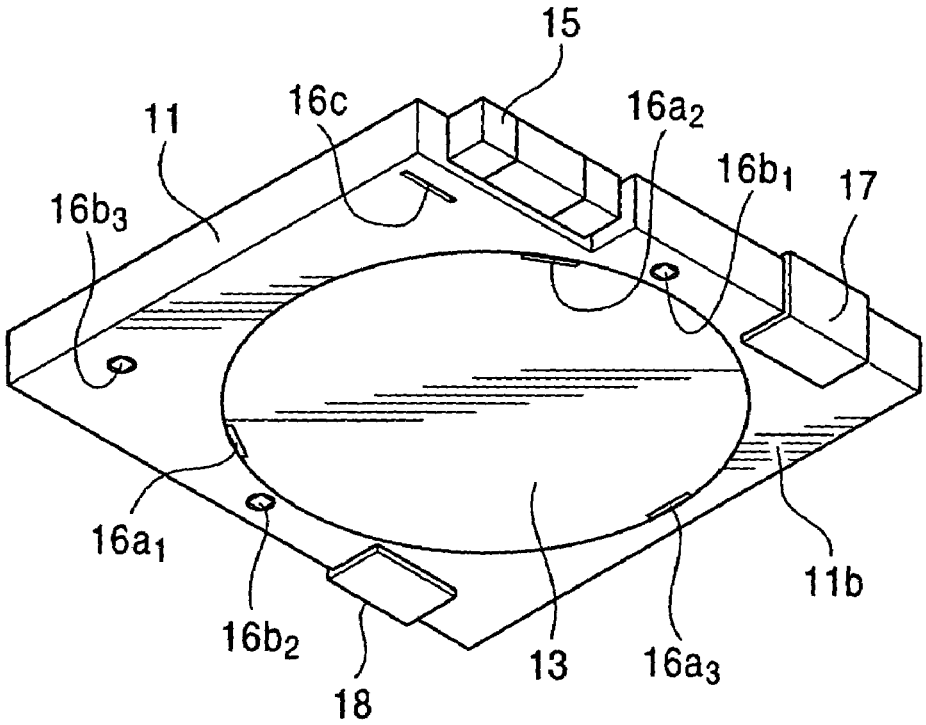
FIG. 3 is an exploded perspective view of the main parts of the isolator according to the first embodiment of the present invention.

FIG. 1 shows an exploded perspective view of an isolator as an example of a nonreciprocal circuit element according to the first embodiment of the present invention. FIG. 2 shows a perspective view of main parts of the isolator. FIG. 3 shows a perspective view of the main parts of the isolator as viewed from another direction.

As shown in FIG. 1, an isolator 1 according to this embodiment includes, as main components, a first yoke 2 (case 6), a biasing permanent magnet 3, an insulating spacer 4, a magnetic-component assembly 10, and a second yoke 5 (case 6).

The permanent magnet 3 applies a DC bias magnetic field to a magnetic plate 11 included in the magnetic-component assembly 10. The insulating spacer 4 is disposed between the permanent magnet 3 and the magnetic-component assembly 10 to prevent contact therebetween.

The first yoke 2 and the second yoke 5 are engaged with each other to form a case 6 of the isolator 1. Furthermore, the second yoke 5 also functions as a grounding electrode of the isolator 1. These yokes are implemented by soft magnetic plates such as soft iron plates or NiFe alloy plates. With regard to the first yoke 2, a soft magnetic plate is bent in a horseshoe shape to form an upper plate 2*a* and walls 2*b* and 2*b*. Similarly, with regard to the second yoke 5, a bottom plate 5*a* and walls 5*b* and 5*b* are formed. Furthermore, the bottom plate 5*a* has a protruding grounding terminal 5*c* that serves as a terminal of the grounding electrode. Furthermore, the bottom plate 5*a* has cutaway portions 5*d* and 5*d* for exposing terminal electrodes 17 and 18 that serve for input and output of the magnetic-component assembly 10.

The first yoke 2 and the second yoke 5 are engaged with each other to form the case 6 having the shape of a hollow rectangular parallelepiped, and the permanent magnet 3, the insulating spacer 4, and the magnetic-component assembly 10 are contained inside the case 6.

As shown in FIGS. 1 to 3, the magnetic-component assembly 10 includes the magnetic plate 11, first, second, and third center conductors 12*a* to 12*c* disposed on a side associated with a first surface 11*a* of the magnetic plate 11, first, second, and third capacitors 14*a* to 14*c* disposed on the side associated with the first surface 11*a* of the magnetic plate 11, and a terminating resistor 15. Furthermore, as shown in FIG. 3, a common electrode 13 is disposed on a side associated with a second surface 11*b* of the magnetic plate 11.

The magnetic plate 11 is formed by sintering ferrite powder such as YIG ferrite (Yttrium-iron-garnet ferrite) powder together with binder or the like at a temperature of 1400° C. to 1500° C., and the magnetic plate 11 has a cutaway portion 11*c* at a part thereof.

Furthermore, the magnetic plate 11 has a plurality of through holes $\mathbf{16}a_1$ to 16*c* running therethrough from the first surface 11*a* to the second surface 11*b*. More specifically, the magnetic plate 11 has through holes $\mathbf{16}a_1$ to $\mathbf{16}a_3$ electrically connecting the center conductors 12*a* to 12*c* to the common electrode 13, and through holes $\mathbf{16}b_1$ to $\mathbf{16}b_3$ electrically connecting the capacitors 14*a* to 14*c* to the bottom surface 5*a* (grounding electrode) of the second yoke 5. Furthermore, the magnetic plate 11 has another through hole 16*c* electrically connecting a first end $\mathbf{12}c_1$ of the third center conductor 12 to the bottom surface 5*a*.

Each of the through holes $\mathbf{16}a_l$ to 16*c* is filled with a conductive material such as silver paste to form electrical connections between the center conductors 12*a* to 12*c* and the common electrode 13, between the capacitors 14*a* to 14*c* and the bottom surface 5*a*, etc.

Since the sintered magnetic plate 11 with the through holes $\mathbf{16}a_1$ to 16*c* formed in advance is used, the magnetic plate 11 that can be sufficiently sintered and that have favorable characteristics can be used, serving to improve characteristics of the isolator 1.

Furthermore, as shown in FIG. 1, the magnetic plate 11 is contained in the case 6 as a component of the magnetic-component assembly 10. Let the vertical dimension of the magnetic plate 11 be denoted as Y1 and the horizontal dimension thereof as X1, and let the vertical dimension of the bottom plate of the second yoke 5 (case 6) be denoted as Y2 and the horizontal dimension thereof as X2, as shown in FIG. 1. Then, the sizes of the magnetic plate 11 and the case 6 are chosen so that Y1 and Y2 substantially coincide with X1 and X2, respectively.

Thus, the size of the magnetic-component assembly 10 as viewed in plan substantially coincides with the size of the bottom plate 5*a* of the second yoke 5 as viewed in plan. Therefore, even if the case 6 is small, a large planar area can be occupied by the magnetic plate 11. Accordingly, L (inductance) can be improved by increasing the lengths of the center conductors 12*a* to 12*c*.

The center conductors 12*a* to 12*c* include a first center conductor 12*a* that is laminated by printing above the first surface 11*a* of the magnetic plate 11 via an insulating layer not shown, a second center conductor 12*b* that is laminated by printing above the first center conductor 12*a* at an angle of approximately 120° via an insulating layer formed by printing or the like, and a third center conductor 12*c* that is laminated by printing above the second center conductor 12*b* at an angle of approximately 120° via an insulating layer. As mentioned above, the center conductors 12*a* to 12*c* cross each other at a predetermined angle. The total thickness of the crossing portion is on the order of 0.1 $\mu$m. Thus, between the magnetic plate 11 and the insulating spacer 4, a gap corresponding to the thickness of the crossing portion of the center conductors 12*a* to 12*c* is formed.

Since the center conductors 12*a* to 12*c* are formed by printing, as opposed to known nonreciprocal circuit elements, center conductors need not be bent, and YIG ferrite need not be encapsulated. Accordingly, the center conductors 12*a* to 12*c* can be precisely positioned on the magnetic plate 11. Furthermore, since the center conductors 12*a* to 12*c* can be formed thin, the isolator 1 can be implemented in a small size.

As shown in FIGS. 2 and 3, the first center conductor 12*a* is disposed with a first end $\mathbf{12}a_1$ thereof in proximity to the terminal electrode 17 for input and a second end $\mathbf{12}a_2$ thereof overlapping the through hole 16*a*1. The second end $\mathbf{12}a_2$ is joined with the conductive material in the through hole $\mathbf{16}a_1$ by solder or the like, whereby the first center conductor 12*a* is connected to the common electrode 13.

Similarly, the second center conductor 12*b* is disposed with a first end $\mathbf{12}b_1$ thereof in proximity to the terminal electrode 18 for output and a second end $\mathbf{12}b_2$ thereof overlapping the through hole 16*a*2. The second end 12*b*2 is joined with the conductive material in the through hole $\mathbf{16}a_2$ by solder or the like, whereby the second center conductor 12*b* is connected to the common electrode 13.

Furthermore, the third center conductor 12*c* is disposed with a first end 12$c_1$ thereof in proximity to the cutaway portion 11*c* of the magnetic plate 11 and a second end 12$c_2$ thereof overlapping the through hole 16*a*3. The second end 12$c_2$ is joined with the conductive material in the through hole 16$a_3$ by solder or the like, whereby the third center conductor 12*c* is connected to the common electrode 13.

Furthermore, the first end 12$c_1$ of the third center conductor also overlaps the through hole 16*c*. The first end 12$c_1$ is joined with the conductive material in the through hole 16*c* by solder or the like, whereby the third center conductor 12*c* is connected to the bottom plate 5*a* (grounding electrode).

As shown in FIG. 3, the common electrode 13 is laminated over the second surface 11*b* of the magnetic plate 11 via an insulating layer not shown. The common electrode 13 is formed so as to overlap the through holes 16$a_1$ to 16$a_3$, and is connected to the center conductors 12*a* to 12*c* via the through holes 16$a_1$ to 16$a_3$, respectively. However, the common electrode 13 is not needed if the center conductors 12*a* to 12*c* are directly connected to the bottom plate 5*a* (grounding electrode) of the second yoke 5 via the through holes 16$a_1$ to 16$a_3$, respectively.

Thus, the center conductors 12*a* to 12*c* and the common electrode 13 are disposed so as to sandwich the magnetic plate 11, thereby forming a microstrip line.

The capacitors 14*a* to 14*c* are disposed on the side associated with the first surface 11*a* of the magnetic plate 11, and include a first capacitor 14*a* disposed in proximity to the first end 12$a_1$ of the first center conductor, a second capacitor 14*b* disposed in proximity to the first end 12$b_1$ of the second center conductor, and a third capacitor 14*c* disposed in proximity to the first end 12$c_1$ of the third center conductor. The capacitors 14*a* to 14*c* are so-called parallel-plate capacitors, and have C (electrostatic capacitances) in accordance with L (inductances) of the center conductors 12*a* to 12*c*, respectively.

Preferably, the thickness of the capacitors 14*a* to 14*c* are substantially the same as the thickness of the crossing portion of the first, second, and third center conductors 12*a* to 12*c*, although it depends on the electrostatic capacitances. More specifically, a thickness on the order of 0.1 mm is preferable.

Since the capacitors 14*a* to 14*c* are disposed on the side associated with the first surface 11*a* of the magnetic plate 11 and have substantially the same thickness as the crossing portion of the center conductors 12*a* to 12*c*, the height of the crossing portion and the height of upper surfaces of the capacitors 14*a* to 14*c* coincide with each other. Thus, the capacitors 14*a* to 14*c* can be disposed in the gap between the magnetic plate 11 and the insulating spacer 4, so that an extra space for disposing the capacitors 14*a* to 14*c* need not be provided separately from the space for disposing the magnetic plate 11. Accordingly, the isolator 1 can be implemented in a small size.

The first capacitor 14*a* is disposed so as to overlap the through hole 16$b_1$, and a terminal of the first capacitor 14*a* is joined with the conductive material in the through hole 16$b_1$ by solder or the like, whereby the first capacitor 14*a* is connected to the bottom plate 5*a* (grounding electrode) of the second yoke 5 via the through hole 16$b_1$.

Similarly, the second capacitor 14*b* is disposed so as to overlap the through hole 16$b_2$, and a terminal of the second capacitor 14*b* is joined with the conductive material in the through hole 16$b_2$ by solder or the like, whereby the second capacitor 14*b* is connected to the bottom plate 5*a* (grounding electrode) via the through hole 16$b_2$.

Furthermore, the third capacitor 14*c* is disposed so as to overlap the through hole 16$b_3$, and a terminal of the third capacitor 14*c* is joined with the conductive material in the through hole 16$b_3$ by solder or the like, whereby the third capacitor 14*c* is connected to the bottom plate 5*a* (grounding electrode) via the through hole 16$b_3$. Furthermore, the third capacitor 14*c* is disposed adjacent to the first end 12$c_1$ of the third center conductor, and is electrically connected to the third center conductor 12*c* via a solder plating layer 4*e*, which will be described later.

The through holes 16$b_1$ to 16$b_3$ are connected to the bottom plate 5*a* on the side associated with the second surface 11*b* of the magnetic plate by solder or the like.

Since the capacitors 14*a* to 14*c* are connected to the grounding electrode 5*a* via the through holes 16$b_1$ to 16$b_3$, respectively, connecting wires need not be provided separately. Accordingly, the structure of the isolator 1 can be simplified to improve mass productivity, and the isolator 1 can be implemented in a small size.

Furthermore, the first, second, and third capacitors 14*a*, 14*b*, and 14*c* are connected to the first ends 12$a_1$, 12$b_1$, and 12$c_1$ of the first, second, and third center conductors via solder plating layers, solder-plated conductor layers, or the like provided in the insulating spacer 4.

More specifically, as shown in FIG. 2, solder plating layers 4*b*, 4*c*, and 4*e* are formed on a surface 4*a*, associated with the magnetic plate, of the insulating spacer 4. The solder plating layer 4*b* is disposed at a position opposing the first end 12$a_1$ of the first center conductor and the first capacitor 14*a*. The solder plating layer 4*c* is formed at a position opposing the first end 12$b_1$ of the second center conductor and the second capacitor 14*b*. The solder plating layer 4*e* is formed at a position opposing the first end 12$c_1$ of the third center conductor and the third capacitor 14*c*.

When the magnetic-component assembly 10 is laminated with the insulating spacer 4, the solder plating layer 4*b* overlaps and bridges the first end 12$a_1$ of the first center conductor and the first capacitor 14*a*, and the solder plating layer 4*c* overlaps and bridges the first end 12$b_1$ of the second center conductor and the second capacitor 14*b*. Similarly, the solder plating layer 4*e* overlaps and bridges the first end 12$c_1$ of the third center conductor and the third capacitor 14*c*. Thus, the capacitors 14*a* and 14*b* are electrically connected to the first ends 12$a_1$ and 12$b_1$ of the center conductors.

The terminating resistor 15 is disposed outside the cutaway portion 11*c* of the magnetic plate 11. The terminating resistor 15 is mounted on the bottom surface 5*a* (grounding electrode) of the second yoke 5.

The terminating electrode 15 is connected to the first end 12$c_1$ of the third center conductor via a solder plating layer, a solder-plated conductor layer, or the like disposed in the insulating spacer 4.

More specifically, as shown in FIG. 2, a solder plating layer 4*d* is formed on the surface 4*a*, associated with the magnetic plate, of the insulating spacer 4. The solder plating layer 4*d* is formed at a position opposing the first end 12$c_1$ of the third center conductor and the terminating resistor 15. When the magnetic-component assembly 10 is laminated with the insulating spacer 4, the solder plating layer 4*d* overlaps and bridges the first end 12$c_1$ of the third center conductor and the terminating resistor 15, whereby an electrical connection is formed therebetween. A terminal of the terminating resistor 15, connected with the first end 12$c_1$ of the third center conductor, and the second yoke 5 are mounted via an insulating film formed by printing or the like.

Since the terminating resistor 15 is mounted on the second yoke 5, a connecting wire can be omitted. Furthermore, since the terminating resistor 15 is connected to the center conductor 12*c* via the solder plating layer 4*d*, a connecting wire need not be separately provided. Thus, the structure of the isolator 1 can be simplified to improve mass productivity, and the isolator 1 can be implemented in a small size.

The terminal electrode 17 serving for input is mounted on a side edge 11*d* of the magnetic plate. The terminal electrode 17 serving for input is disposed in proximity to the first end $12a_1$ of the first center conductor on the side edge 11*d*.

The terminal electrode 18 serving for output is mounted on another side edge 11*e* of the magnetic plate. The terminal electrode 17 serving for output is disposed in proximity to the first end $12b_1$ of the second conductor on the side edge 11*e*.

The terminal electrodes 17 and 18 are each formed substantially in a horseshoe shape, and are engaged with the side edges 11*d* and 11*e* of the magnetic plate so as to extend from the first surface 11*a* to the second surface 11*b* of the magnetic plate. Since the terminal electrodes 17 and 18 are engaged with the magnetic plate 11 as described above, only small spaces are occupied by the terminal electrodes 17 and 18, so that the isolator 1 can be implemented in a small size.

Furthermore, the solder plating layers 4*a* to 4*e* on the insulating layer 4 can be omitted by applying solder plating or cream-like solder on the first to third capacitors 14*a* to 14*c* and the terminating resistor 15 so that the associated center conductors are extended and overlapped.

The terminal electrodes 17 and 18 can be connected to the first ends $12a_1$ and $12b_1$ of the center conductors by overlapping the terminal electrodes 17 and 18 with the first ends $12a_1$ and $12b_1$ and sandwiching and fixing the first ends $11a_1$ and $11b_1$ between the terminal electrodes 17 and 18 and the magnetic plate 11. Alternatively, similarly to the case of the capacitors 14*a* to 14*c*, the solder plating layers 4*b* and 4*c* are disposed so as to overlap and bridge the first ends $12a_1$ and $12b_1$ and the terminal electrodes 17 and 18, thereby forming electrical connections therebetween.

By connecting the center conductors 12*a* and 12*b* to the terminal electrodes 17 and 18 via the solder plating layers 4*b* and 4*c*, connecting wires need not be provided. Thus, the structure of the isolator 1 can be simplified to improve mass productivity, and the isolator 1 can be implemented in a small size.

As described above, the capacitors 14*a* to 14*c* for matching are connected to the first ends $12a_1$ to $12c_1$ of the respective center conductors, and the terminating resistor 15 is connected to the first end $12c_1$ of the third center conductor. These elements are contained in the case 6 (the first and second yokes 2 and 5) together with the permanent magnet 4 so that the permanent magnet 4 is allowed to apply a DC magnetic field on the magnetic-component assembly 10, whereby the isolator 1 is formed. In the isolator 1, the first center conductor 12*a* connected to the terminal electrode 17 serves for input and the second center conductor 12*b* connected to the terminal electrode 18 serves for output.

According to the isolator 1 described above, the sizes of the case 6 and the magnetic plate 11 substantially coincide with each other, so that a large planar area can be occupied by the magnetic plate 11. Accordingly, L (inductance) can be increased and C (capacitances of capacitors) can be decreased by extending the lengths of the center conductors 12*a* to 12*c*, serving to reduce loss caused by the nonreciprocal circuit element 1.

Figure 4A:
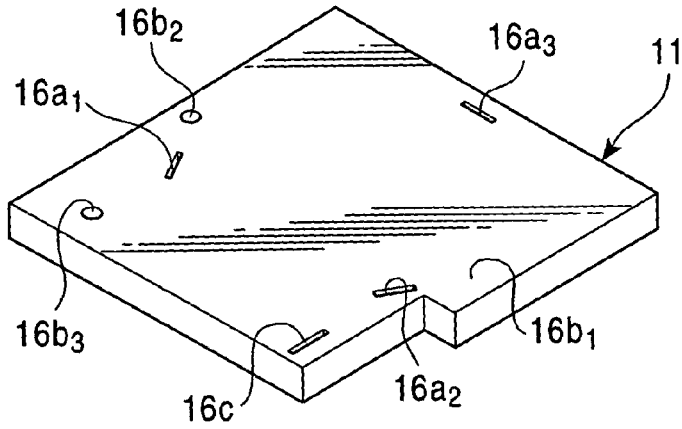
FIGS. 4A to 4C are process charts for explaining a method of manufacturing the isolator according to the first embodiment.
Figure 4B:
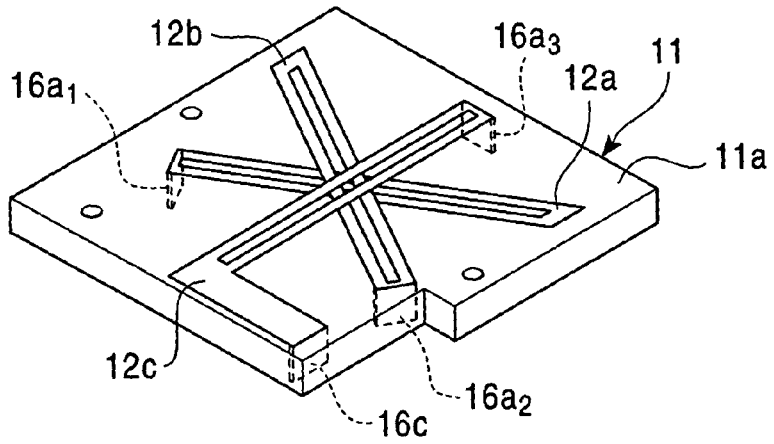

In order to manufacture the isolator 1 described above, as shown in FIG. 4A, the magnetic plate 11 with the through holes $16a_1$ to 16*c* formed in advance is prepared, and the through holes $16a_1$ to 16*c* are filled with silver paste or the like. Then, as shown in FIG. 4B, the first, second, and third center conductors 12*a* to 12*c* are formed by printing on the side associated with the first surface 11*a* of the magnetic plate. Between the center conductors 12*a* to 12*c*, and between the first center conductor 12*a* and the magnetic plate 11, insulating layers not shown are formed by means of printing or the like. Furthermore, the center conductors 12*a* to 12*c* are connected to the through holes $16a_1$ to $16a_3$ and 16*c* by soldering or the like.

Figure 4C:
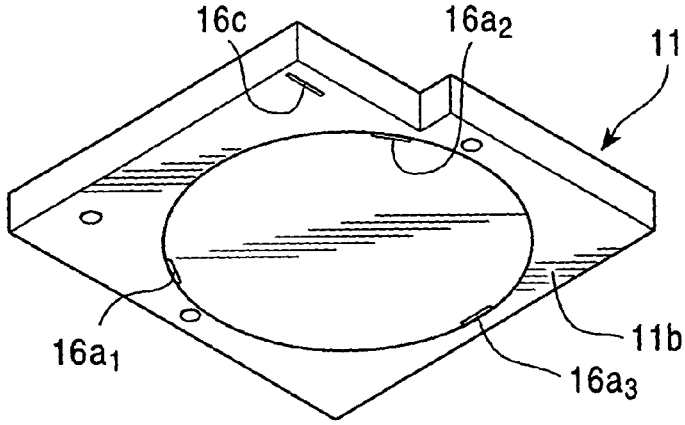

Then, as shown in FIG. 4C, the common electrode 13 is formed on the side associated with the second surface 11*b* of the magnetic plate. The common electrode 13 is formed so as to overlap the through holes $16a_1$ to $16a_3$, and the common electrode 13 is connected to the through holes $16a_1$ to $16a_3$ by soldering or the like. However, the common electrode 13 is not needed if the center conductors 12*a* to 12*c* are directly connected to the bottom plate 5*a* (grounding electrode) of the second yoke 5 via the through holes $16a_1$ to $16a_3$.

Figure 5A:
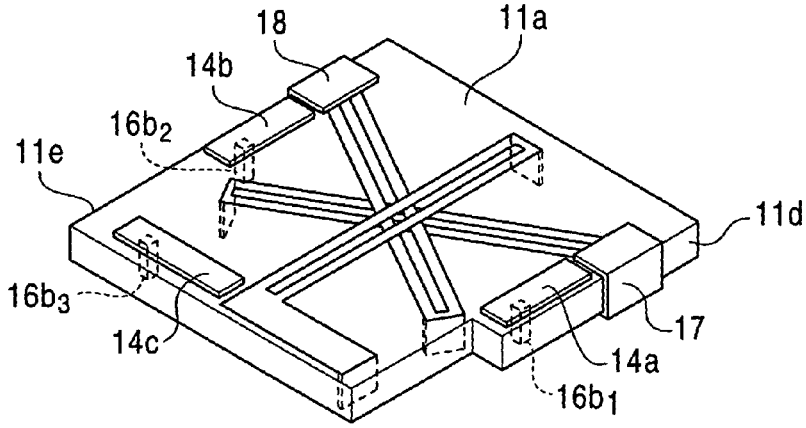
FIGS. 5A and 5B are process charts for explaining the method of manufacturing the isolator according to the first embodiment.

Then, as shown in FIG. 5A, the first to third capacitors 14*a* to 14*c* are disposed over the through holes $16b_1$ to $16b_3$ on the first surface 11*a* of the magnetic plate, and the capacitors 14*a* to 14*c* are connected to the through holes $16b_1$ to $16b_3$ by soldering or the like. Furthermore, the terminal electrodes 17 and 18 are engaged with the side edges 11*d* and 11*e* of the magnetic plate 11.

Figure 5B:
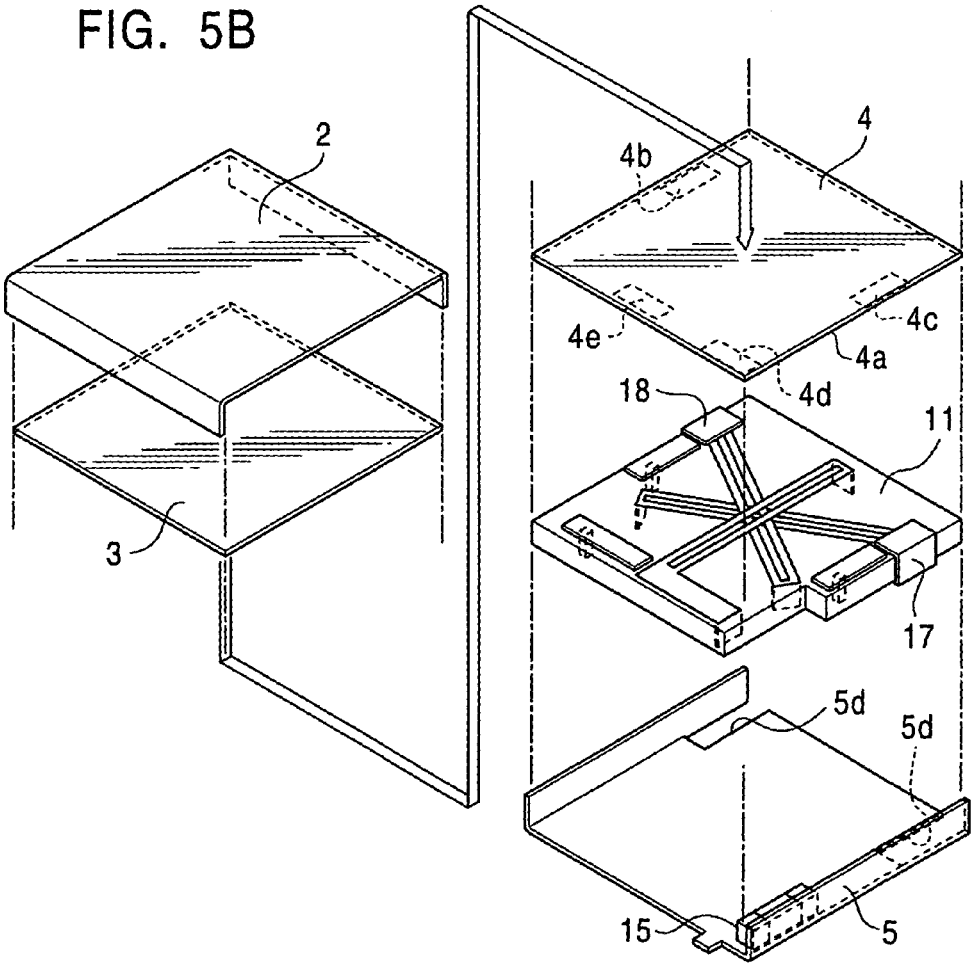

Then, as shown in FIG. 5B, the insulating spacer 4 and the permanent magnet 3 are sequentially laminated on the side associated with the first surface 11*a* of the magnetic plate 11, and these elements are sandwiched by the first and second yokes 2 and 5. The first and second yokes 2 and 5 consequently form the case 6 of the isolator 1. Furthermore, at this time, the terminal electrodes 17 and 18 are exposed from the terminal holes 5*d* and 5*d* of the second yoke 5.

Before combining the components, the solder plating layers 4*b* to 4*e* are formed in advance on the surface 4*a* of the insulating spacer. The solder plating layers 4*b* to 4*e* are formed so as to overlap, at least, the first ends $12a_1$ to $12c_1$ of the respective center conductors. Furthermore, the terminating resistor 15 is mounted in advance on the second yoke 5 such that a hot-side terminal is insulated from the second yoke 5 by a printed insulating film or the like.

Finally, the entire assembly is heated to melt the solder plating layers, whereby electrical connections are formed between the center conductors 12*a* to 12*c* and the capacitors 14*a* to 14*c* and between the terminal electrodes 17 and 18 and the terminating resistor 15.

According to the method of manufacturing the isolator 1, described above, the insulating spacer 4 is laminated over the center conductors 12*a* to 12*c*, and then the solder plating layers 4*b* to 4*d* are melted by heat to form electrical connections between the center conductors 12*a* to 12*c* and the capacitors 14*a* to 14*c* and between the terminal electrodes 17 and 18 and the terminating resistor 15. Thus, a process of bending center conductors and a process of individually soldering capacitors and terminal electrodes, which have hitherto been required, are omitted, serving to improve productivity.

Furthermore, since the method simply incorporates the constituent components sequentially and then applies heat thereto, the constituent components can be precisely positioned and assembled.

SECOND EMBODIMENT

Next, an isolator according to a second embodiment of the present invention will be described with reference to the drawings.

Figure 6:
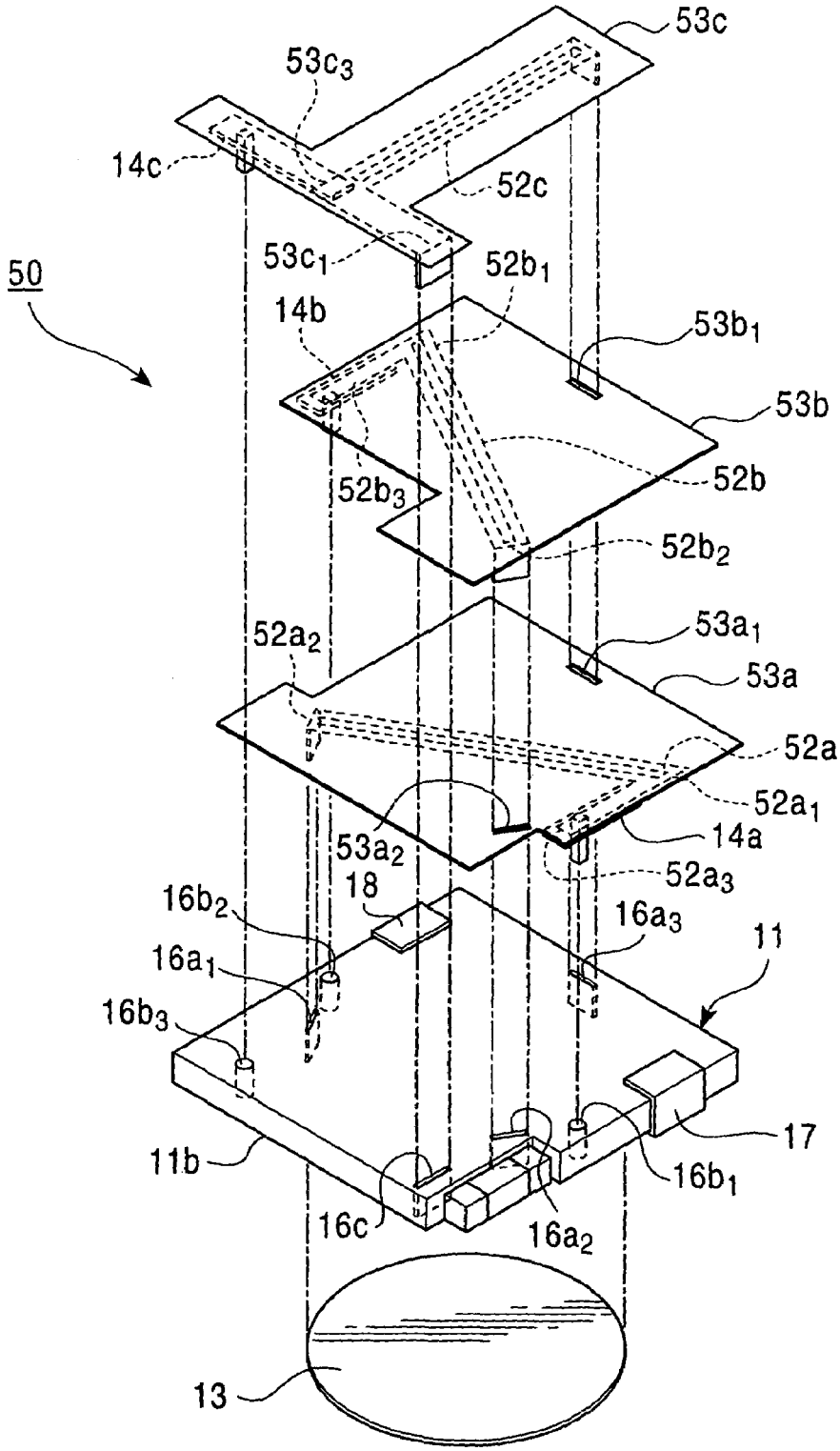
FIG. 6 is an exploded perspective view of main parts of an isolator according to a second embodiment of the present invention.

FIG. 6 shows an exploded perspective view of a magnetic-component assembly 50 constituting the isolator according to the second embodiment of the present invention.

Of components constituting the magnetic-component assembly 50 shown in FIG. 6, constituent components corresponding to the constituent components of the magnetic-component assembly 10 shown in FIGS. 1 to 6 are designated by the same numerals, and descriptions thereof will be omitted or simplified.

As shown in FIG. 6, the magnetic-component assembly 50 of the isolator according to this embodiment includes a magnetic plate 11, a plurality of center conductors 52*a* to 52*c* disposed on a side associated with a first surface 11*a* of the magnetic plate 11, a plurality of capacitors 14*a* to 14*c* disposed on the side associated with the first surface 11*a* of the magnetic plate, and a terminating resistor 15. Furthermore, a common electrode 13 is disposed on a side associated with a second surface 11*b* of the magnetic plate 11.

Furthermore, the magnetic plate 11 has a plurality of through holes $\mathbf{16}a_1$ to 16*c*.

The center conductors 52*a* to 52*c* are formed respectively on surfaces of insulating films 53*a* and 53*c* composed of polyimide or the like.

More specifically, a first center conductor 52*a* is formed on a lower surface of the insulating film 53*a* as viewed in the figure. The insulating film 53*a* is implemented by a flexible substrate composed of polyimide or the like. Furthermore, the insulating film 53*a* has connecting holes $\mathbf{53}a_1$ and $\mathbf{53}a_2$ for connecting the second and third center conductors 52*b* and 52*c* to the through holes $\mathbf{16}a_2$ and $\mathbf{16}a_3$. Furthermore, a connecting conductor $\mathbf{52}a_3$ is formed at a first end $\mathbf{52}a_1$ of the first center conductor, and a first capacitor 14*a* is attached from the lower surface of the insulating film 53*a* so as to overlap the connecting conductor $\mathbf{52}a_3$.

Similarly, a second center conductor 52*b* is formed on a lower surface of the insulating film 53*b* as viewed in the figure. The insulating film 53*b* has a connecting hole $\mathbf{53}b_1$ for connecting the third center conductor 52*c* to the through hole $\mathbf{16}a_3$. Furthermore, a connecting conductor $\mathbf{52}b_3$ is formed at a first end $\mathbf{52}b_1$ of the second center conductor, and a second capacitor 14*b* is attached from the lower surface of the insulating film 53*b* so as to overlap the connecting conductor $\mathbf{52}b_3$.

Furthermore, a third center conductor 52*c* is formed on a lower surface of the insulating film 53*c* as viewed in the figure. A connecting conductor $\mathbf{52}c_3$ is formed at a first end $\mathbf{52}c_1$ of the third center conductor, and a third capacitor 14*c* is attached from the lower surface of the insulating film 53*c* so as to overlap the connecting conductor $\mathbf{52}c_3$.

The insulating film 53*a* is formed in a shape such that it does not interfere with the first ends $\mathbf{52}b_1$ and $\mathbf{52}c_1$ of the second and third center conductors and with the second and third capacitors 14*b* and 14*c*. Also, the insulating film 53*b* is formed in a shape such that it does not interfere with the first end $\mathbf{52}c_1$ of the third center conductor and with the third capacitor 14*c*.

Thus, when the insulating films 53*a* to 53*c* are laminated over the magnetic plate 11, the first ends $\mathbf{52}b_1$ and $\mathbf{52}c_1$ of the second and third center conductors and the second and third capacitors 14*b* and 14*c* come in direct contact with the first surface 11*a* of the magnetic plate without being interfered with by the insulating films 53*a* and 53*b*.

More specifically, when the insulating films 53*a* to 53*c* are laminated over the magnetic plate 11, the first end $\mathbf{52}a_1$ of the first center conductor 52*a* overlaps the terminal electrode 17 serving for input, and these elements are connected to each other by solder or the like. Furthermore, a second end $\mathbf{52}a_2$ overlaps the through hole $\mathbf{16}a_1$, and the second end $\mathbf{52}a_2$ is joined with a conductive material in the through hole 16*a*1 by solder or the like, whereby the first center conductor 52*a* is connected to the common electrode 13.

Similarly, the first end $\mathbf{52}b_1$ of the second center conductor overlaps the terminal electrode 18 serving for output, and these elements are connected to each other by solder or the like. Furthermore, a second end $\mathbf{52}b_2$ overlaps the through hole $\mathbf{16}a_2$, and the second end $\mathbf{52}b_2$ is joined with a conductive material in the through hole $\mathbf{16}a_2$ by solder or the like, whereby the second center conductor 52*b* is connected to the common electrode 13.

Furthermore, the first end $\mathbf{53}c_1$ of the third center conductor overlaps a cutaway portion 11*c* of the magnetic plate 11, and a second end $\mathbf{52}c_2$ overlaps the through hole 16*a*3. Then, the second end $\mathbf{52}c_2$ is joined with a conductive material in the through hole $\mathbf{16}a_3$ by solder or the like, whereby the third center conductor 52*c* is connected to the common electrode 13.

Furthermore, the first end $\mathbf{53}c_1$ of the third center conductor overlaps the through hole 16*c*, and the first end $\mathbf{52}c_1$ is joined with a conductive material in the through hole 16*c* by solder or the like, whereby the third center conductor 52*c* is connected to a second yoke (grounding electrode) not shown.

The center conductors 52*a* to 52*c* and the common electrode 13 are disposed so as to sandwich the magnetic plate 11, whereby a microstrip line is formed. Alternatively, the center conductors 52*a* to 52*c* may be directly connected to the second yoke not shown via the through holes $\mathbf{16}a_1$ to $\mathbf{16}a_3$, respectively, in which case the common electrode 13 is not needed.

Furthermore, by laminating the insulating films 53*a* to 53*c* over the magnetic plate 11, the center conductors 52*a* to 52*c* cross each other at a predetermined angle.

Furthermore, when the insulating films 53*a* to 53*c* are laminated over the magnetic plate 11, the first capacitor 14*a* overlaps the through hole $\mathbf{16}b_1$, and the first capacitor 14*a* is joined with a conductive material in the through hole $\mathbf{16}b_1$ by solder or the like, whereby the first capacitor 14*a* is connected to the second yoke (grounding electrode) not shown.

Similarly, the second capacitor 14*b* overlaps the through hole $\mathbf{16}b_2$, and the second capacitor 14*b* is joined with a conductive material in the through hole $\mathbf{16}b_2$ by solder or the like, whereby the second capacitor 14*b* is connected to the second yoke (grounding electrode) not shown.

Furthermore, the third capacitor 14*c* overlaps the through hole $\mathbf{16}b_3$, and the third capacitor 14*c* is joined with a conductive material in the through hole $\mathbf{16}b_3$ by solder or the like, whereby the third capacitor 14*c* is connected to the second yoke (grounding electrode) not shown.

Furthermore, the first end $\mathbf{53}c_1$ of the third center conductor overlaps the terminating resistor 15, whereby the third center conductor 53*c* is connected to the terminating resistor.

Preferably, the thickness of the second capacitor 14*b* is substantially the same as the thickness of the insulating film 53*a*, although it depends on electrostatic capacitance. Also preferably, the thickness of the third capacitor 14*c* is substantially the same as the total thickness of the insulating films 53*a* and 53*b*. Also, the first capacitor 14*a* is preferably as thin as possible. Alternatively, the arrangement may be such that a portion of the insulating film 53*c* over the capacitor 14*b* and the insulating films 53*b* and 53*c* over the first capacitor 14*a* are eliminated to absorb the thickness of the capacitors.

Since the capacitors 14*b* and 14*c* do not interfere with the insulating film 53*a* and the capacitor 14*c* does not interfere with the insulating film 53*b*, by choosing the thickness of the second and third capacitors 14*b* and 14*c* as described above, the capacitors 14*b* and 14*c* can be disposed in a gap between the magnetic plate 11 and an insulating spacer not shown, so that a space for disposing the capacitors 14*a* to 14*c* need not be provided separately from a space for disposing the magnetic plate 11. Accordingly, the isolator 1 can be implemented in a small size.

As described above, the capacitors 14*a* to 14*c* for matching are connected to the first ends $\mathbf{52}a_1$ to $\mathbf{52}c_1$ of the center conductors, respectively, and the first end $\mathbf{52}c_1$ of the third center conductor is connected to the terminating resistor 15. These components, together with a permanent magnet not shown, are contained in a case (first and second yokes) not shown so that a DC magnetic field can be applied to the magnetic-component assembly 50, whereby the isolator according to this embodiment is formed. In this isolator, the first center conductor 52*a* connected to the terminal electrode 17 serves for input, and the second center conductor 52*b* connected to the terminal electrode 18 serves for output.

According to the isolator of this embodiment, the center conductors 52*a* to 52*c* are formed on the insulating films 53*a* to 53*c*, respectively, and the insulating films 53*a* to 53*c* are laminated over the magnetic plate 11. Thus, as opposed to known nonreciprocal circuit elements, center conductors need not be bent, and the center conductors 53*a* to 53*c* can be precisely positioned with respect to the magnetic plate 11. Furthermore, the center conductors 52*a* to 52*c* can be formed thin, so that the isolator can be implemented in a small size.

In order to manufacture the isolator according to this embodiment, the insulating films 53*a* to 53*c* with the center conductors 53*a* to 53*c* and the capacitors 14*a* to 14*c* formed in advance are sequentially laminated on the side associated with the first surface 11*a* of the magnetic plate, the common electrode 13 is formed on the side associated with the second surface 11*b* of the magnetic plate, and the terminal electrodes 17 and 18 are engaged with side edges 11*d* and 11*e* of the magnetic plate 11, whereby the magnetic-component assembly 50 shown in FIG. 6 is formed. The magnetic-component assembly 50, together with the insulating spacer and the permanent magnet, is contained in the case formed by the first and second yokes, and the terminal electrodes 17 and 18 are exposed from terminal holes of the second yoke.

This manufacturing method simply mounts the center conductors 52*a* to 52*c* and the capacitors 14*a* to 14*c* simultaneously on the magnetic plate 11 and incorporates the common electrode 13 and the terminal electrodes 17 and 18. Thus, a process of bending center conductors and a process of individually soldering capacitors and terminal electrodes, which have hitherto been required, are omitted, serving to improve productivity. Furthermore, since the method simply incorporates constituent components sequentially, the constituent components can be precisely positioned and assembled.

The technical scope of the present invention is not limited to the embodiments described above, and various modifications can be made without departing from the spirit of the present invention. For example, although the first and second embodiments described above relate to isolators in which a terminating resistor is connected to a third center conductor, a terminal electrode may be connected to the third center conductor to form a circulator.

What is claimed is:

1. A nonreciprocal circuit element comprising:

a magnetic plate having a plurality of through holes;

a plurality of center conductors crossing each other at a predetermined angle on a side associated with a first surface of the magnetic plate; and a common electrode disposed on a side associated with a second surface of the magnetic plate and connected to the center conductors via the through holes, wherein capacitors connected to first ends of the center conductors are disposed on the side associated with the first surface of the magnetic plate, and a case is formed by a first yoke disposed on the side associated with the first surface of the magnetic plate, and a second yoke disposed on the side associated with the second surface of the magnetic plate so as to also function as a grounding electrode, the capacitors being connected to the second yoke via other through holes provided in the magnetic plate.

2. A nonreciprocal circuit element according to claim 1, wherein the magnetic plate is contained in a case, and at least one of a vertical dimension and a horizontal dimension of the magnetic plate substantially coincides with a vertical dimension or a horizontal dimension of an interior of the case.

3. A nonreciprocal circuit element according to claim 1, wherein terminal electrodes connected to first ends of the center conductors are engaged with side edges of the magnetic plate.

4. A nonreciprocal circuit element according to claim 1, wherein the center conductors are formed, by printing, over the magnetic plate via insulating layers.

5. A nonreciprocal circuit element according to claim 1, wherein an insulating spacer and a biasing permanent magnet are laminated on the side of the first surface of the magnetic plate, solder plating layers are formed on one surface, associated with the magnetic plate, of the insulating spacer, the solder plating layers electrically connecting the first ends of the center conductors to the capacitors and the terminal electrodes, respectively.

6. A nonreciprocal circuit element according to claim 1, wherein a terminating resistor is connected to one of the center conductors.

7. A nonreciprocal circuit element according to claim 6, wherein the terminating resistor is mounted on a yoke, and the terminating resistor is electrically connected to the center conductors via a solder plating layer formed on one surface, associated with the magnetic plate, of an insulating spacer.

8. A nonreciprocal circuit element according to claim 1, wherein the center conductors are formed on insulating films, and the insulating films are laminated over the magnetic plate with the center conductors facing the magnetic plate.

9. A nonreciprocal circuit element according to claim 8, wherein the capacitors are disposed on the insulating films.

10. A nonreciprocal circuit element comprising:

a magnetic plate having through holes;

a plurality of insulating layers;

a plurality of center conductors laminated together via the insulating layers, the center conductors disposed on a side associated with a first surface of the magnetic plate;

a common electrode formed on a side associated with a second surface of the magnetic plate, capacitors disposed in proximity to first ends of the center conductors;

terminal electrodes engaged with side edges of the magnetic plate and adjacent to the first ends of the center conductors;

an insulating spacer having solder plating layers laminated over the magnetic plate such that the solder plating layers are opposed to the first ends of the center conductors, wherein the solder plating layers electrically connect the first ends of the center conductors to the capacitors and the terminal electrodes.

11. A nonreciprocal circuit element according to claim 10, wherein the center conductors are connected to the common electrode via the through holes.

12. A nonreciprocal circuit element comprising:

a magnetic plate having a plurality of through holes;

a plurality of center conductors crossing each other at a predetermined angle on a side associated with a first surface of the magnetic plate; and a common electrode disposed on a side associated with a second surface of the magnetic plate and connected to the center conductors via the through holes, wherein capacitors connected to first ends of the center conductors are disposed on the side associated with the first surface of the magnetic plate, and wherein an insulating spacer and a biasing permanent magnet are laminated on the side of the first surface of the magnetic plate, solder plating layers are formed on one surface, associated with the magnetic plate, of the insulating spacer, the solder plating layers electrically connecting the first ends of the center conductors to the capacitors and the terminal electrodes, respectively.

13. A nonreciprocal circuit element according to claim 12, wherein the magnetic plate is contained in a case, and at least one of a vertical dimension and a horizontal dimension of the magnetic plate substantially coincides with a vertical dimension or a horizontal dimension of an interior of the case.

14. A nonreciprocal circuit element according to claim 12, wherein terminal electrodes connected to first ends of the center conductors are engaged with side edges of the magnetic plate.

15. A nonreciprocal circuit element according to claim 12, wherein the center conductors are formed, by printing, over the magnetic plate via insulating layers.

16. A nonreciprocal circuit element according to claim 12, wherein the center conductors are formed on insulating films, and the insulating films are laminated over the magnetic plate with the center conductors facing the magnetic plate.

17. A nonreciprocal circuit element according to claim 16, wherein the capacitors are disposed on the insulating films.

18. A nonreciprocal circuit element according to claim 12, wherein a terminating resistor is connected to one of the center conductors.

19. A nonreciprocal circuit element according to claim 18, wherein the terminating resistor is mounted on a yoke and is electrically connected to the center conductors via one of the solder plating layers.

20. A nonreciprocal circuit element comprising:

a magnetic plate having a plurality of through holes;

a plurality of center conductors crossing each other at a predetermined angle on a side associated with a first surface of the magnetic plate; and a common electrode disposed on a side associated with a second surface of the magnetic plate and connected to the center conductors via the through holes, wherein a terminating resistor is connected to one of the center conductors, is mounted on a yoke, and is electrically connected to the center conductors via a solder plating layer formed on one surface, associated with the magnetic plate, of an insulating spacer.

21. A nonreciprocal circuit element according to claim 20, wherein the magnetic plate is contained in a case, and at least one of a vertical dimension and a horizontal dimension of the magnetic plate substantially coincides with a vertical dimension or a horizontal dimension of an interior of the case.

22. A nonreciprocal circuit element according to claim 20, wherein capacitors connected to first ends of the center conductors are disposed on the side associated with the first surface of the magnetic plate.

23. A nonreciprocal circuit element according to claim 20, wherein terminal electrodes connected to first ends of the center conductors are engaged with side edges of the magnetic plate.

24. A nonreciprocal circuit element according to claim 20, wherein the center conductors are formed, by printing, over the magnetic plate via insulating layers.

25. A nonreciprocal circuit element according to claim 20, wherein the center conductors are formed on insulating films, and the insulating films are laminated over the magnetic plate with the center conductors facing the magnetic plate.

26. A nonreciprocal circuit element according to claim 25, wherein capacitors are disposed on the insulating films.

27. A nonreciprocal circuit element comprising:

a magnetic plate having a plurality of through holes;

a plurality of center conductors crossing each other at a predetermined angle on a side associated with a first surface of the magnetic plate; and a common electrode disposed on a side associated with a second surface of the magnetic plate and connected to the center conductors via the through holes, wherein the center conductors are formed on insulating films, the insulating films are laminated over the magnetic plate with the center conductors facing the magnetic plate, and capacitors are disposed on the insulating films.

28. A nonreciprocal circuit element according to claim 27, wherein the magnetic plate is contained in a case, and at least one of a vertical dimension and a horizontal dimension of the magnetic plate substantially coincides with a vertical dimension or a horizontal dimension of an interior of the case.

29. A nonreciprocal circuit element according to claim 27, wherein the capacitors are connected to first ends of the center conductors and are disposed on the side associated with the first surface of the magnetic plate.

30. A nonreciprocal circuit element according to claim 27, wherein terminal electrodes connected to first ends of the center conductors are engaged with side edges of the magnetic plate.

31. A nonreciprocal circuit element according to claim 27, wherein the center conductors are formed, by printing, over the magnetic plate via insulating layers.

* * * * *